United States Patent [19]

Van Hoek et al.

[11] 4,336,112

[45] Jun. 22, 1982

[54] METHOD OF MANUFACTURING MOULDS FOR DISC-SHAPED RECORD CARRIERS, AND MOULDS MANUFACTURED BY MEANS OF SUCH A METHOD

[75] Inventors: Martinus A. F. Van Hoek; Jan L. Melse, both of Eindhoven, Netherlands

[73] Assignee: U.S. Philips Corporation, New York, N.Y.

[21] Appl. No.: 207,327

[22] Filed: Nov. 17, 1980

[30] Foreign Application Priority Data

Dec. 10, 1979 [NL] Netherlands ..... 7908858

[51] Int. Cl.[3] ..... C25D 1/10

[52] U.S. Cl. ..... 204/5; 204/DIG. 7

[58] Field of Search ..... 204/5, 6, 281, DIG. 7

[56] References Cited

U.S. PATENT DOCUMENTS 2,044,431 6/1936 Harrison ..... 204/DIG. 7

2,372,567 3/1945 Graham ..... 204/DIG. 7

2,675,348 4/1954 Greenspan ..... 204/5

*Primary Examiner*—T. Tufariello

*Attorney, Agent, or Firm*—Norman N. Spain

[57] ABSTRACT

A method of manufacturing moulds for disc-shaped record carriers, and moulds manufactured by means of such a method.

A method of manufacturing moulds for disc-shaped record carriers where a glass plate which contains information and which comprises a central hole and is covered with a vapor-deposited silver layer is suspended in an electroforming bath by means of a suspension pin which contacts the edge of the central hole. The mould is electroformed by application of current via the suspension pin and a metallic strip arranged around the outer circumference. After this treatment, the plate is removed from the electroplating bath and the electroformed mould is removed from the plate.

4 Claims, 2 Drawing Figures

METHOD OF MANUFACTURING MOULDS FOR DISC-SHAPED RECORD CARRIERS, AND MOULDS MANUFACTURED BY MEANS OF SUCH A METHOD

The invention relates to a method of manufacturing moulds for disc-shaped record carriers, where a glass plate, comprising a central hole and provided with a layer of photoresist containing the information which is covered with a vapour-deposited layer of silver, is suspended in an electroforming bath by way of a suspension pen which contacts the edge of the central hole, after which current is applied via the suspension pin and the mould is electroformed, after which the plate is removed from the bath and the electroformed mould is removed from the plate.

Moulds for the manufacture of audio and/or video discs are made by means of the described electroforming method. This known method has the drawback that the passage of current through the metal suspension pin to the silver layer on the glass plate is problematic. The silver layer is very thin, for example, in the order of magnitude of 100 nm, and it tends to burn in the zone around the central hole at the customary current intensity. In order to avoid such burning, initially a low current intensity which is gradually increased is often used. The electro-forming time is thus substantially increased, which has an adverse effect on the production speed.

A second drawback of the known method consists in that the layer thickness of the deposited layer, for example, a nickel layer, is irregular. At the edge a thicker, often also rougher layer is formed which imposes problems when the electroformed peals are separated from the plate. In order to avoid these problems, the thickened, rough edge has to be mechanically removed, for example, by filling or grinding. The diameter of the plate thus decreases as the number of copies increases.

The invention has for its object to provide a method of manufacturing moulds where a mould of uniform thickness can be electroformed in a short period of time.

In order to achieve this object, the method in accordance with the invention is characterized in that a metallic strip is arranged around the outer circumference of the plate, said strip being electrically conductively connected to the suspension pin.

As a result of this simple step, the area of contact with the thin silver layer is greatly increased, so that the full current intensity can be immediately applied without the risk of burning.

Due to the uniform application of current to the inner as well as the outer circumference and due to the shielding effect of the contact strip on the edge, a very uniform thickness distribution of the electroformed mould is obtained, so that mechanical working of the outer edge is no longer necessary. The production is thus faster as well as cheaper.

In a further embodiment, the width of the metallic strip exceeds the thickness of the plate. This ensures suitable contact with the silver layer and, thanks to the acute angle between the strip and plate, the mould will not be attached to the strip.

The ease of removal of the mould is further enhanced by constructing the strip to be arcuated in accordance with the invention.

The invention will be described in detail hereinafter with reference to the accompanying diagrammatic drawing.

Figure 1:
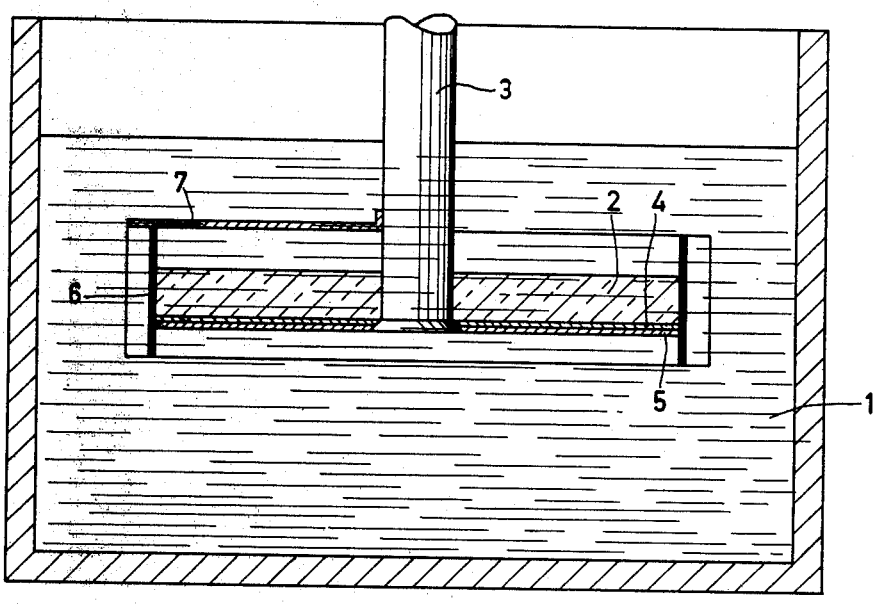
FIG. 1 shows an electroforming bath containing a glass plate supported by a suspension pin not to scale.
Figure 2:
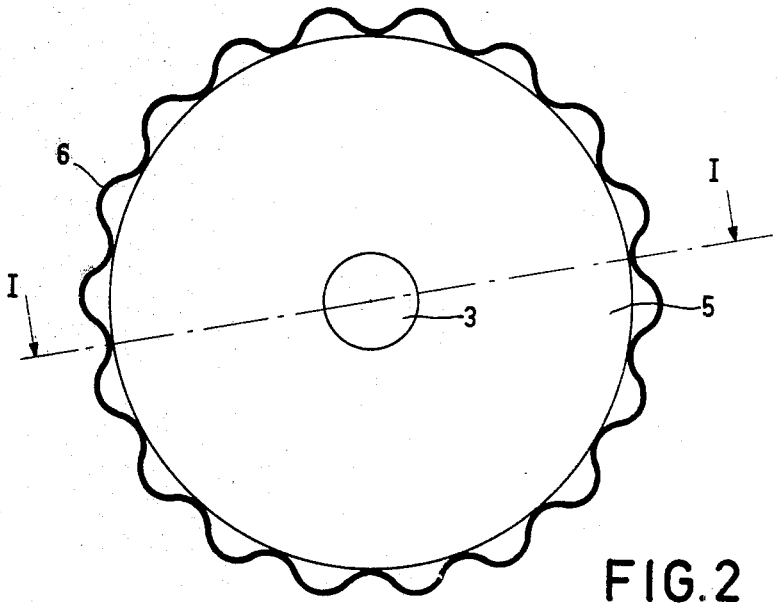
FIG. 2 is a plan view of the assembly formed by the glass plate, the suspension pin and the current application strip.

The reference numeral 1 in FIG. 1 denotes an electroforming bath. A glass plate 2 which is connected to a suspension pin 3 is suspended in this bath. The glass plate 2 is provided on its lower side with a layer 4 of cured photoresist in which the information is contained. The photoresist layer 4 is covered with a very thin silver layer 5.

The outer circumference of the plate 2 is enclosed by an undulated strip 6 which is connected to the metal suspension pin 3 via one or more current-carrying wires 7. The suspension pin 3 is connected to a current source (not shown).

When current is applied to the suspension pin 3, it will flow, via the contact between the pin and the silver layer 5, along the circumference of the central hole of the plate 2 and through the silver layer. The current will also enter the silver layer 5 via the connections 7 and the metal strip 6 via the outer edge. As a result of the large contact area between on the one hand the suspension pin 5 and on the other hand the metal strip 6 and the silver layer, a high current intensity can be immediately applied without burning of the silver layer.

As a result of the uniform current distribution across the silver layer 5, the metal from the electroforming bath will be very uniformly deposited on the silver layer, so that a mould of very uniform thickness is obtained which no longer requires mechanical working.

Thanks to the acute angle between the strip 6 and the silver layer 5, the mould will not be attached to the strip. The ease of removal of the mould is further enhanced by the undulated shape of the strip.

What is claimed is:

1. A method of manufacturing molds for disc-shaped record carriers comprising the steps of suspending a disc-shaped glass plate provided with a central hole in an electroforming bath, at least one surface of which plate is provided with a layer of an information contacting photoresist coated with a vapor deposited silver layer, by means of a suspension pin containing the edge of said central hole, applying current to said silver layer through said suspension pin until said mold is electroformed and then removing the resultant electroformed mold from said bath, characterized in that during the application of the current to the silver layer, a current carrying metallic strip, electrically connected to the suspension pin, is kept in contact with and surrounds the outer circumference of said plate.

2. A method as claimed in claim 1, characterized in that the width of the metallic strip exceeds the thickness of the plate.

3. A method as claimed in claim 1 or 2, characterized in that the metallic strip has an undulated shape.

4. A mould for manufacturing disc-shaped record carriers manufactured by means of the method claimed in claim 1.

* * * * *

UNITED STATES PATENT AND TRADEMARK OFFICE

CERTIFICATE OF CORRECTION

PATENT NO. : 4,336,112

DATED : June 22, 1982

INVENTOR(S) : MARTINUS A.F. VAN HOEK ET AL

It is certified that error appears in the above—identified patent and that said Letters Patent is hereby corrected as shown below:

Col. 2, Lines 48 and 49 change "contacting" to --containing--.

Col. 2, Line 50, change "containing" to -- contacting --.

Signed and Sealed this

*Thirty-first* Day of *August 1982*

[SEAL]

*Attest:*

GERALD J. MOSSINGHOFF

*Attesting Officer*

*Commissioner of Patents and Trademarks*